US005392616A

United States Patent [19]

Ballenegger

[11] Patent Number: 5,392,616

[45] Date of Patent: Feb. 28, 1995

[54] CONNECTION ELEMENT FOR JEWELLERY

[76] Inventor: Charles Ballenegger, 1172 Bougy-Villars, Switzerland

[21] Appl. No.: 30,325

[22] PCT Filed: Jul. 3, 1992

[86] PCT No.: PCT/EP92/01495

§ 371 Date: Mar. 10, 1993

§ 102(e) Date: Mar. 10, 1993

[87] PCT Pub. No.: WO93/02584

PCT Pub. Date: Feb. 18, 1993

[30] Foreign Application Priority Data

Aug. 1, 1991 [FR] France ..... 91 09814

[51] Int. Cl.[6] ..... A44C 11/02

[52] U.S. Cl. ..... 63/2; 24/575

[58] Field of Search ..... 63/2, 3, 4; 24/575, 24/576, 579.1, 615

[56] References Cited

U.S. PATENT DOCUMENTS

| | | | |
|---|---|---|---|
| 910,340 | 1/1909 | Wittstein | 63/2 |
| 2,615,227 | 10/1952 | Hornik | 63/2 |
| 4,569,106 | 2/1986 | Lovato | 24/576 |
| 4,621,393 | 11/1986 | Ambal | 24/576 |
| 4,667,378 | 5/1987 | Sturm | 63/2 |
| 5,203,058 | 4/1993 | Krauss | 24/576 |

FOREIGN PATENT DOCUMENTS

| | | | |
|---|---|---|---|
| 1026725 | 4/1953 | France | 24/576 |

*Primary Examiner*—Flemming Saether
*Attorney, Agent, or Firm*—Kenneth M. Massaroni

[57] ABSTRACT

The connection element (2, 3) according to the present invention comprises a housing, and is capable of forming a symmetrical body such as a sphere (1) in cooperation with a second, essentially identical connection element as a result of the assembly of said two elements in mutually upside-down orientation. The interface portions between the housings of the two elements (2, 3) comprise portions which are cut in a plane parallel to the axis of the sphere, which axis is defined as the line which passes through the two opposing fixation points of the sphere to the ends of a necklace or the like, as well as portions which are cut in a plane which is inclined with respect to this axis to permit maintenance of the engagement of the two connection elements even under the application of a traction force onto the two fixation points. The elements according to the present invention comprise also two flexible pins (6, 7) which permit to maintain two connection elements in their respective engaged positions.

9 Claims, 4 Drawing Sheets

CONNECTION ELEMENT FOR JEWELLERY

FIELD OF THE INVENTION

The present invention relates to a connecting device such as used in the fields of jewelry and watch making, in particular for necklaces or bracelets, which is operable in collaboration with a second connection element.

BACKGROUND

In the field of jewlry numerous types of connections between the two ends of a necklace or a bracelet or the end of a necklace and a piece of jewlry are known already, whereby these connection elements comprise a male piece and a female piece, the latter having frequently the form of a length wise extended U which is provided to be introduced in the male piece. The flexibility of the U is further used to produce a latching effect once the female piece has been properly received in the male piece.

Typically, these connection elements, which are frequently called clasps, are themselves executed in a manner as to constitute a piece of jewlry and the clasp, for exemple for a pearl necklace forms an integral portion thereof and can not be exchanged by the owner of the necklace if she would wish to modify the optical appearance thereof. In a pearl necklace, the clasp is typically held by a loop of the thread on which the pearls are arranged. In other applications, the clasp of the necklace is directly brased to the last link of the necklace in the same way as for other metal jewlry.

Further, in particular for pearl necklaces, the thread which carries the series of pearls is formed to a loop at the end of the chain, and this loop engages with a metallic eye which is fastened to each classical connection element. This loop of the thread is suject to considerable abration where it is in contact with the metallic eye, and traditionally, in order to protect this thread, the latter is itself protected by a helically wound metallic wire which runs around the thread of the necklace in a way similar to a piano cord, and which comes into contact with the metal of the eye without permitting excessive friction between the thread of the necklace and the eye.

This technique, although technically satisfactory, comprises certain aesthetic disadvantages because the wire can not be hidden and represents therefore a not very aesthetic element in a number of embodiments of this type of connection.

SUMMARY OF THE INVENTION

The present invention has the objective to eliminate these inconveniences and to propose a connection element for use in jewlry such as mentioned above, which is further characterized in that it comprises a housing substantially representing one half of a symmetric body, such as a sphere, and an elastic pin which is attached to the housing, which pin consists of a multiply bent rod or band, whereby said housing comprises a slot which is positioned opposite to the location where the pin is situated in order to permit the insertion of a pin of a second, subtantially identical connection element into the first connection element which is positioned in a 180° rotated orientation with respect to said first connection element during connection of the free ends of the necklace or the bracelet or of one of these ends with a piece of jewlry comprising said second connection element.

According to a particular embodiment of this invention and in the case where two identical elements are used upside-down with respect to each other, the external outline of the two assembled elements can form a sphere which comprises, hidden therewithin or projecting outwardly therefrom two knee portions of the two pins at opposite sides. In other embodiments, the pin may be formed such as to stay within the sphere, and the "sphere" may assume the shape of a cyclinder or have a parallelepipedical shape.

In the embodiment of the present invention where the connection elements form a sphere, the housings comprise cut portions whereof a first cut portion is subtantially semi-circular, and corresponds to a partial cut of a hollow sphere following a plane substantially parallel to the axis of the sphere defined by the two projecting portions of the pins, a second substantially semi-circular cut portion parallel to the first cut portion and whereof the plane of section is situated at the same distance from but on the opposite side of said axis than the first cut portion, the first and second cut portions being arranged in respectively opposing semi-spheres defined by a sectional central plane which is perpendicular to said axis; and a third and fourth cut portion whereof each connects two corresponding end portions of said first and second cut portions, and being inclined such as to form sharp angles between themselves and the first and second cut portions respectively.

When two substantially identical elements are assembled in an orientation upside-down to each other, the first cut portion of the first element abuts on the second cut portion of the second element, and the second cut portion of the first element abuts on the first cut portion of the second element, the pin of the first element is received in the slot of the second element and the pin of the second element is received in the slot of the first element.

Advantageously, the pin is connected to the housing approximately at the apex of the first cut portion.

Said pin may comprise a first section neighbouring the point of the connection of the pin with the first cut portion, whereby this first section is oriented such as to project outwardly or to follow the outline of the sphere which is formed during assembly of the two elements in mutually upside-down condition, a second section which is bent back such as to return towards the interior or to be directed essentially towards the center of the sphere, and a third section which is located essentially in the area of and between the third and fourth cut portions of the connection element, whereby this third section comprises a contact surface in order to cooperate with the corresponding contact surface of the pin of the second connection element which, during assembly of the two elements comes into contact and abuts against the contact surface of the pin of the first element.

Alternatively, the first section of the pin may be alined within the outline of the sphere or of any other symmetrical form which has been chosen for the connection elements according to the present invention, and the second and third sections of the pin may be arranged together with the first section such as to form a triangle, whereby the free end of the third section abuts on the source of the first section.

According to another embodiment, the first section of the pin comprises at its one end which is projecting from the sphere, a hole for the passage of a fixation thread which passes therethrough coming from the outside and passing into the sphere, whereby this thread will be fastened within the sphere around the other sections of the pin, in particular around the third section.

Alternatively, the pin may be brased at this location to the end of a necklace, or other.

In this embodiment, the second section of the pin comprises a security lug in order to assure anchoring of the portion of the pin within the sphere and to protect thus the pin against extraction from the sphere as a result of accidental application of an excessive traction force.

Further the first section of the pin may comprise a recessed portion in order to cooperate with the free end of the third section which has a fork-like shape, whereof the two points are arranged on either .side of the recessed portion of the first section after the bending of the sections of the pin. In the embodiment where the pin does not project from the outline of the symmetric body, the free end of the third section of the pin may comprise a transversal lug with which said end abuts on the first section of the pin. This lug may snugly fit to the interior shape of the symmetrical body.

A connection element according to the present invention may be utilised in order to cooperate with a second identical connection element in mutually upside-down fashion, or it may be utilised simply in cooperation with a slot, whereby said connection element is introduced into said slot, which is arranged in a piece of jewlry, in order to realise a connection between said element and said piece of jewlry.

For such utilisation, the slot may comprise a transverse dimension by mention which is inferior to the dimensions of the connection element, however comprising a widened portion which is larger than the connection element or a flexible portion in order to permit the insertion of said element.

The present invention will now be described in more detail with reference to the drawings whereof:

DETAILED DESCRIPTION OF THE INVENTION

Figure 1A:
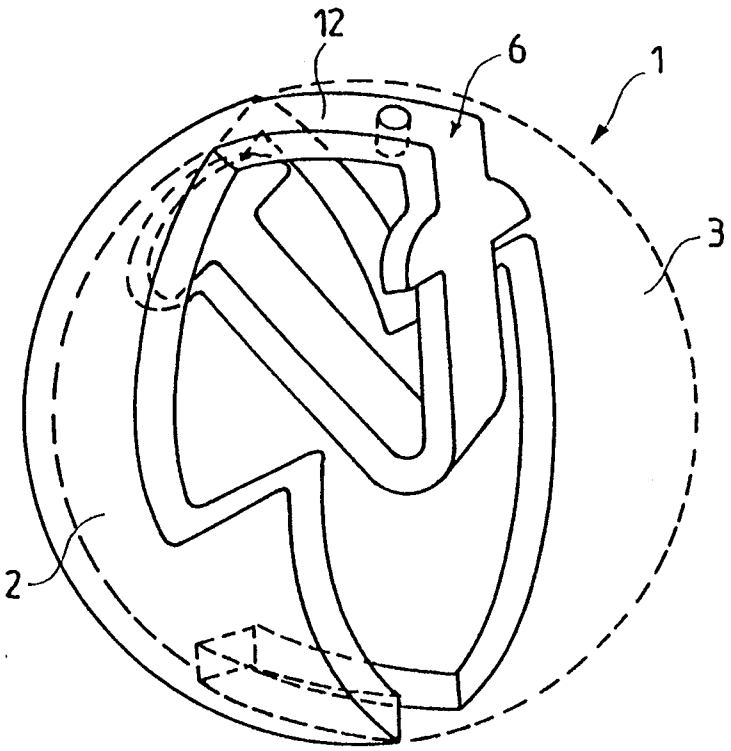
FIG. 1*a* is an alternative embodiment of a detail of FIG. 1, FIGS. 2, 3 and 4 are sectional views according to the three axes in space of a connection element according to the present invention.
Figure 1:
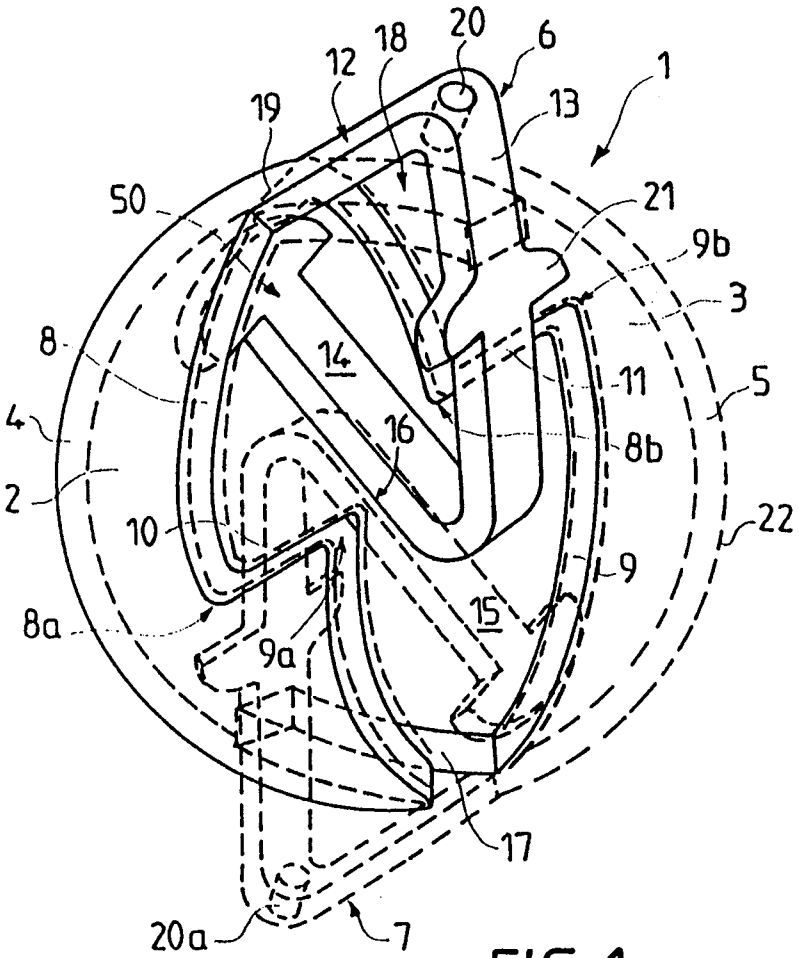
FIG. 1 is a perspective view of a connection element according to the present invention in cooperation with a second identical element in mutually upside-down orientation.

With reference to FIG. 1, the invention is described by way of example as a symmetrical body represented by a hollow sphere 1 formed by assembly of two connection elements 2 and 3, in mutually upside-down orientation, whereby elements 2 and 3 comprise housings formed of metal of respective thicknesses 4 and 5. At the interface between elements 2 and 3, the contact surfaces between these two elements do not follow a circular section such as one could obtain by a central section or even at a section outside of the center of a sphere, but this interface is formed by the following cut portions:

A first, essentially semi-circular cut portion 8 which is arranged such as to follow a section plane parallel to an axis which is defined by holes 20 and 20*a* (who's function will be described thereafter) and a certain distance away from this axis.

A second cut-section 9 is formed following a sectional plane which is parallel to the sectional plane of the first cut portion, whereby this second sectional plane is located on the opposite side of the axis with respect to said first plane and in the same distance thereof.

The ends 8*a* and 8*b* of the first cut portion 8 are connected to ends 9*a* and 9*b* of the second cut portion 9 by third and fourth cut portions 10 and 11 respectively, which are arranged in inclined orientation with respect to said first and second cut portions 8 and 9.

The second connection element 3 is essentially identical to the first one, and assembled with the latter in mutually upside-down orientation, in order to complete the first element such as to form an entire sphere.

As mentioned above, the shape of a sphere is to be understood as an example only and may be replaced by any symmetric shape.

The second connection element 3 is drawn in dashed lines in FIG. 1 for reasons of clarity.

In the area of the apex 19 of first cut portion 8 of the first connection element 2 a pin 6 is anchored such as to play the role of a fixation element in order to maintain the two semi-spherical connection elements in contact with each other in their assembled position. Pin 6 comprises a first section 12 which is connected integrally to the first cut portion 8 and is oriented such as to project outwardly from the sphere which is formed by the two connection elements 2 and 3. It is to be understood that the projection of the pin outside of the sphere is not necessary, said pin may also remain within the outline of the sphere.

A second section 13 of pin 6 is oriented such as to return towards the interior of sphere 1 and a third section 14 is arranged in the center of the sphere essentially parallel to and between the two cut portions 10 and 11.

The third section 14 of pin 6 comprises a contact surface 16 which abuts on the corresponding contact surface of pin 7 of the second connection element 3.

The housings of the two connection elements 2 and 3 comprise further slots 17 and 18 essentially in the area of the apex of the second cut portion of each element, whereby these slots are provided to permit the passing of the second or of the first and second sections of the pin 6 during assembly of the two connection elements immediately before their final connection.

In the region of the knees between the first and second sections of each pin 6 and 7, there are holes 20 and 20*a* for the passage of a thread, in particular the thread of a pearl necklace, whereby the end of this thread can be fixed at the interior of the sphere, for example at the third section of the pin. Typically the thread of a pearl necklace enters through hole 20 and slot 18 and turns around the third section 14 of pin 6 within the sphere, and exits again by hole 20 in order to return through the holes of one or two pearls of the necklace before being fixed between two pearls.

Pins 6 and 7 are flexible and the contact surfaces 16 are arranged such as to provoke a flexible deformation of the pins during assembly of the two connection elements in order to obtain a certain pressure between the third sections of pins 6 and 7, whereby this pressure is a result of an identical pressure between the third and fourth cut portions 10 and 11 of the first connection element 2 on the respective third and fourth cut portions of the second connection element 3.

After the assembly of the two connection elements 2 and 3, any traction force which may be applied to these elements may only appear in a more or less axial sense such as to separate the two housings in a direction defined by a line passing through the center of the sphere and through the holes 20 and 20*a*, whereby such separation is made impossible due to the abutment of the third and fourth cut portions 10 and 11 of the respective connection elements.

In FIG. 1*a* one can see the outline of sphere 1 and pin 6 which remains within this outline.

Figure 2:
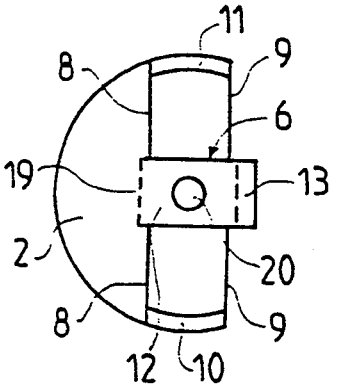

FIG. 2 illustrates an axial view (in a direction parallel to the axis defined by the holes 20 and 20*a*) of a connection element 2 according to the present invention.

The cut portion 8 and the cut portion 9 represent a projection line in this view angle and one can see the position of the sectional planes according to cut portions 8 and 9 on either sides and equidistantly of the axis which passes through hole 20 perpendicularly to the drawing plane.

One can see also the projections of the third and fourth cut portions 10 and 11, which portions are oriented in inclined orientation with respect to cut portions 8 and 9 and which can be seen therefore more or less in a plane view.

Pin 6 which projects from apex 19 of the first cut portion 8, comprises a hole 20 at the interface between the first section 12 and the second section 13 of the pin 6.

Figure 3:
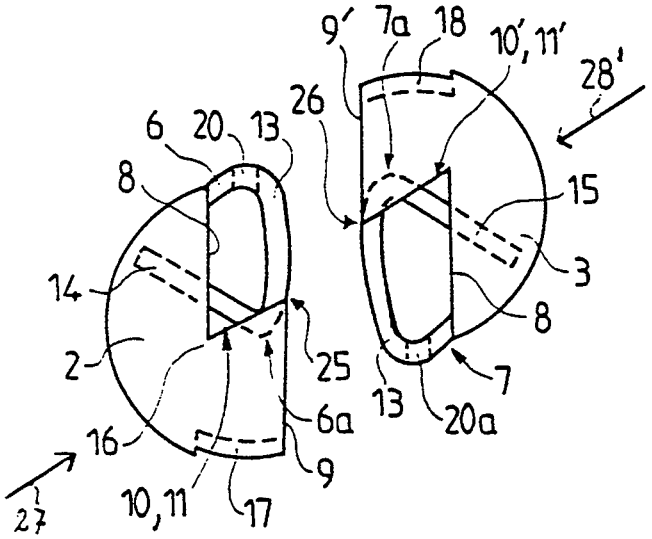

FIG. 3 illustrates a first connection element 2 and a second connection element 3 immediately before their final connection which will be effected by approaching the two elements in a direction according to arrows 27 and 28', such that the third cut portion 10 of the first element 2 slides over the fourth cut portion 11' of the second element 3 and the fourth cut portion 11 of the first element 2 slides over the third cut portion 10' of the second element 3. In order to arrive to a complete assembly of the two elements one effectuates a first phase of approach during which the two portions 6*a* and 7*a* of pins 6 and 7 are deformed until the knee 7*a* can pass over the knee 6*a* and hereafter the two elements are completely combined by a movement during which the third and fourth cut portions 11 and 10 of one element slide on the respective portions of the second element at the same time as a gradual relief of the deformed pins will take place, whereby it is to be understood that a certain residual deformation is to be maintained after complete engagement of the two elements in order to firmly maintain said elements in position.

Of course, the overlapping of the interior portion of the pin and of the cut portion 10 such as illustrated in the projectional view of FIG. 3 is dimensioned such as to produce a non-excessive deformation of the pins while obtaining simultaneously a secure final engagement.

During approach of the two elements, section 13 of pin 6 engages within slot 18 and section 13' of pin 7 engages within slot 17 of the respectively opposed element.

Figure 4:
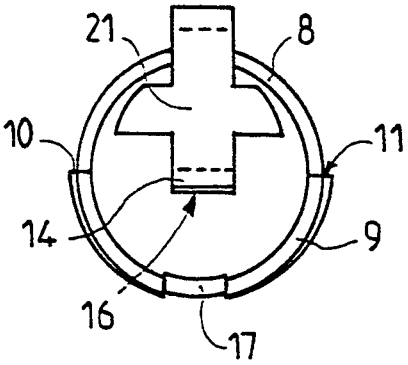

FIG. 4 is a view of a connection element according to the present invention, taken in a direction parallel to the direction of approach of the two elements during assembly, and the portions of this element which are identical with those of other Figures are designated with the same reference numbers than in those other Figures.

Figure 5:
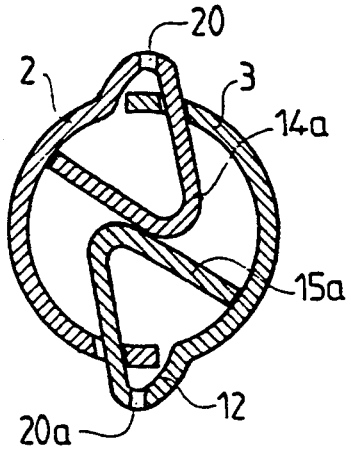
FIG. 5 is an axial section of a sphere formed by assembly of two connection elements in mutually upside-down orientation.

FIG. 5 is a sectional view of two elements assembled in mutually upside-down orientation such as described in connection with FIG. 3. The pins 14*a*, 15*a* of these elements may comprise contact surfaces having step portions in order to permit a snap in action during the final phase of their approach.

Figure 6:
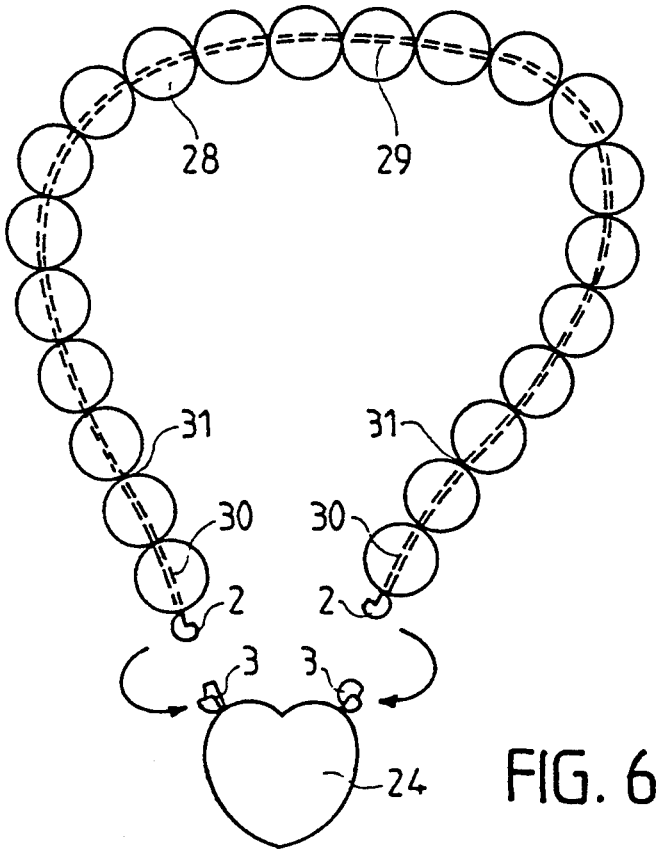
FIG. 6 shows the closure of a pearl necklace by an independent piece of jewlry which is effectuated by means of two pairs of connection elements according to the present invention.

FIG. 6 illustrates a pearl necklace comprising a plurality of pearls 28 which are arranged on a thread 29, forming a loop outside of the last pearl 30 at each end of the necklace, whereby this loop is returned through the holes of the two last pearls and fixed to the thread at 31 between the second and the third last pearls at each end of the necklace.

The loop of the thread which projects from the last pearl engages at each end of the necklace with a connection element according to the present invention, such as to permit either to close the necklace by assembling the two connection elements 2 such as described hereinabove under FIG. 3, or one may provide a piece of jewlry 24 as decorating element of the pearl necklace, and this piece of jewlry may comprise two connection elements 3 according to the present invention which may be assembled with the connection elements 2 on the respective ends of the necklace in order to form a chain whereof the piece of jewlry 24 constitutes a link.

Figure 7A:
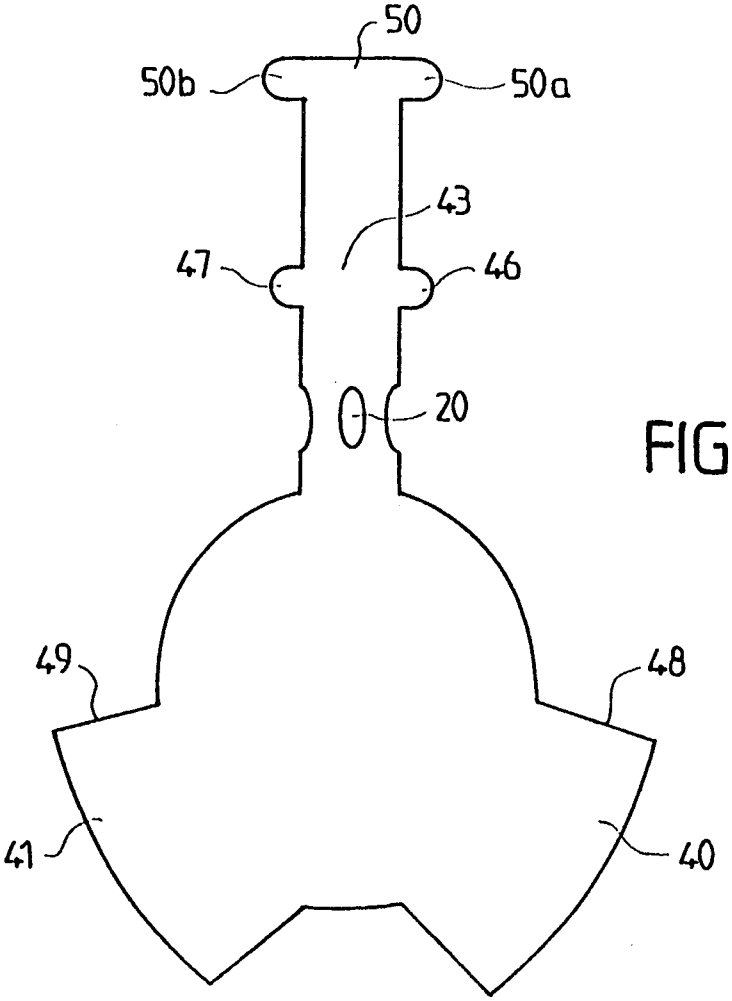
FIGS. 7 and 7*a* show a punched sheet material for the production of a connection element according to the present invention and FIGS. 8 and 8*a* show a different embodiment of a connection element according to the present invention.
Figure 7:
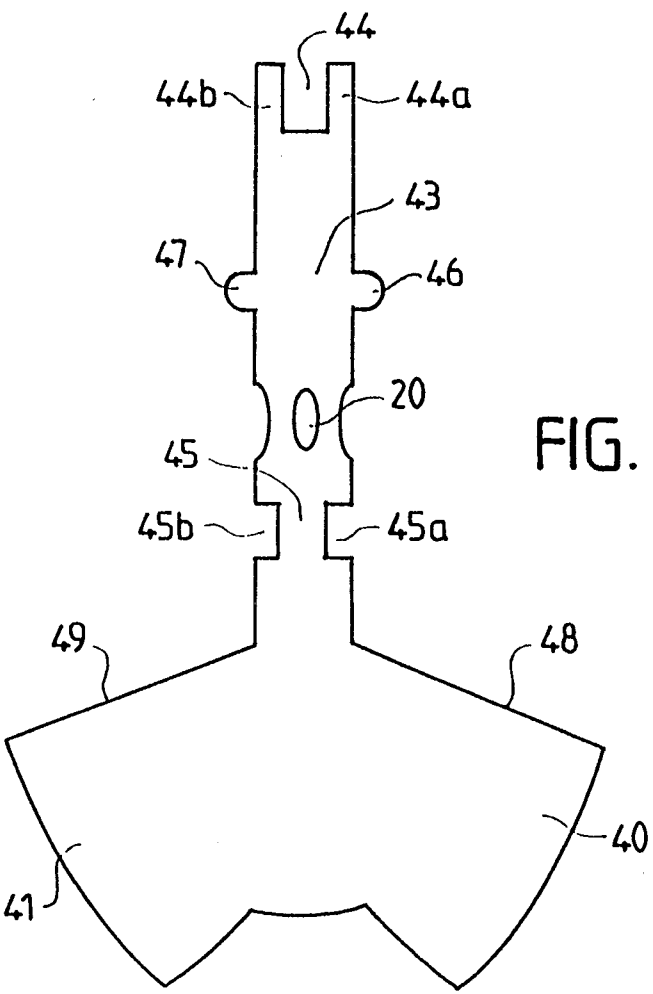

FIG. 7 illustrates a piece of punched sheet material which is designed such as to be formed to a connection element according to the present invention by a pressing operation.

This piece of sheet material comprises two wings 40 and 41 provided to be formed to essentially semi-spherical configuration, and a strip portion 43 which is to be bent twice in order to form an essentially triangular pin, such that free portion 44 which comprises points 44*a* and 44*b* engages with portion 45 which is a recess portion in strip 43 by forming two recesses 45*a* and 45*b* with which points 44*a* and 44*b* cooperate after the bending of strip 43.

Strip 43 further comprises a hole 20 and lugs 46 and 47, whereby hole 20 permits the introduction of a fixation thread such as described hereinabove, and whereby lugs 46 and 47 permit to anchor the pin at the interior of the sphere and to protect the pin against extraction from the sphere as a result of the application of excessive forces.

Points 44*a* and 44*b* as well as lugs 50*a* and 50*b* permit to maintain the pin in position.

Cut portions 48 and 49 of wings 40 and 41 correspond to said third and fourth cut portions 10 and 11 of FIG. 1 and are oriented such as to be inclined after formation of the semi-sphere to be oriented in a plane according to the cut portions 10 and 11 of FIG. 1, in order to produce the interface between the two connection elements in a way similar to that of FIG. 8 below.

Figure 8A:
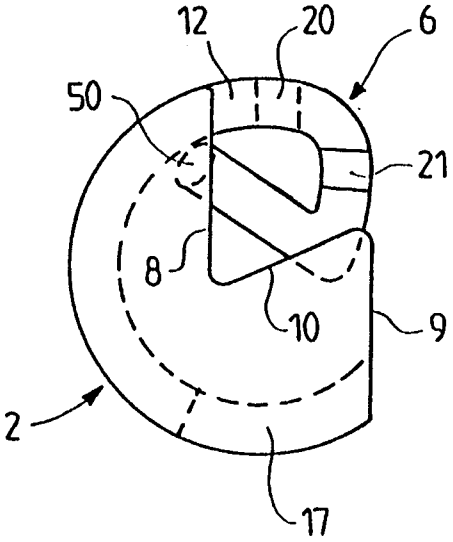
Figure 8:
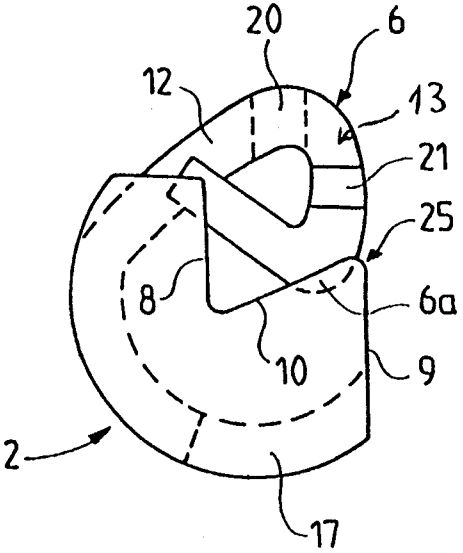

FIG. 8 illustrates a connection element according to the present invention, seen from an angle identical to the one of FIG. 3. In this embodiment, sections 12 and 13 project outside of the outline of the sphere and FIG. 8*a* illustrates an embodiment of a connection element according to the present invention where pin 6 stays entirely within the outline of the sphere.

I claim:

1. A spherically shaped jewelry connection device having first and second semi-spherical connection elements, each said connection element comprising:

a housing having first and second ends, and first and second cut portions disposed between said first and second ends, said first cut portion being substantially semi-circular, and corresponding in shape to a partial section of a hollow sphere in a plane substantially parallel to an axis of the sphere of the device, and said second cut portion positioned in inclined orientation with respect to said first cut portion, the first and second cut portions of said first connection element are adapted to conformally engage the first and second cut portions of said second connection element;

a pin integral to and extending from said first end of said housing, said pin comprising a strip having a plurality of bends formed therein, and defining a first section, a second section, and a third section, said first section being oriented to project out of the sphere defined by the jewelry connection device, said second section disposed at an angle to said first section, and extending into said sphere, and said third section disposed at an angle to said second section at an area interior of said sphere, said third section forming a contact surface, whereby the contact surface of said first connection element contacts the contact surface of said second connection element; and a slot formed in the second end of said housing, said slot adapted to engage the pin of the other connection element.

2. A jewelry connection device as in claim 1, wherein said first connection element is oriented in 180° rotated position with respect to said second connection element.

3. A jewelry connection device as in claim 1, wherein the combination of the first and second elements, when cooperatively engaged, defines an exterior outline corresponding to a sphere including first and second bent portions, including said first and second sections of said pin, extending from opposite sides of said sphere.

4. A jewelry connection device as in claim 1, wherein the first cut portion of the first connection element abuts the first cut portion of the second connection element, and the second cut portion of the first connection element abuts the second cut portion of the second connection element.

5. A jewelry connection device as in claim 1, wherein the pin is connected to the housing at the apex of the first cut portion.

6. A jewelry connection device as in claim 1, wherein the first section of the pin further comprises a hole for the passage of a fixation thread which passes through said hole.

7. A jewelry connection device as in claim 1, wherein said second section of said pin further comprises a lug for anchoring the pin within said housing.

8. A jewelry connection device as in claim 1, wherein said third section of said pin further comprises a lug for anchoring the pin within said housing.

9. A jewelry connection device as in claim 1, wherein the first section of the pin further comprises a recessed portion.

* * * * *